US009081355B2

(12) United States Patent
Minemura

(10) Patent No.: US 9,081,355 B2
(45) Date of Patent: Jul. 14, 2015

(54) RECOVERY UNIT AND IMAGE FORMING APPARATUS

(71) Applicant: KONICA MINOLTA, INC., Tokyo (JP)

(72) Inventor: Taisuke Minemura, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 11 days.

(21) Appl. No.: 13/712,599

(22) Filed: Dec. 12, 2012

(65) Prior Publication Data

US 2013/0156475 A1 Jun. 20, 2013

(30) Foreign Application Priority Data

Dec. 15, 2011 (JP) ..... 2011-274099

(51) Int. Cl.
*G03G 21/12* (2006.01)
*G03G 21/10* (2006.01)
*G03G 21/00* (2006.01)

(52) U.S. Cl.
CPC ..... *G03G 21/12* (2013.01); *G03G 21/0011* (2013.01); *G03G 21/10* (2013.01); *G03G 2221/1618* (2013.01); *G03G 2221/1624* (2013.01)

(58) Field of Classification Search
CPC ..... G03G 15/00
USPC ..... 399/360
See application file for complete search history.

(56) References Cited

U.S. PATENT DOCUMENTS

| | | | | |
|---|---|---|---|---|
| 5,933,690 | A * | 8/1999 | Sugimoto et al. | 399/257 |
| 2007/0048050 | A1* | 3/2007 | Fahmy et al. | 399/358 |
| 2008/0187378 | A1* | 8/2008 | Lim | 399/360 |
| 2013/0156475 | A1* | 6/2013 | Minemura | 399/360 |
| 2013/0251433 | A1* | 9/2013 | Toshiyuki | 399/358 |

FOREIGN PATENT DOCUMENTS

| | | | | |
|---|---|---|---|---|
| JP | H06242674 | * | 9/1994 | G03G 15/00 |
| JP | H06258943 | * | 9/1994 | G03G 15/00 |

(Continued)

OTHER PUBLICATIONS

Opinion on Examination, Intellectual Property Ofice of the Peoples Republic of China Patent Application 2012105444781, Jul. 3, 2014, pp. 1-13.*

(Continued)

*Primary Examiner* — Clayton E Laballe
*Assistant Examiner* — Kevin Butler
(74) *Attorney, Agent, or Firm* — Lucas & Mercanti, LLP

(57) ABSTRACT

A reserve portion is an inner tube that reserves waste toner in a reserve space in a main body of the reserve portion, and includes a protrusion row on an outer peripheral surface. A recovery inlet is formed in an upper portion of the reserve portion. A container portion is an outer tube that incorporates the reserve portion. An inlet protruding the container portion is formed in a lower portion of a side wall of the container portion. A driving unit makes the reserve portion rotate with respect to the container portion about a rotational shaft integrally formed with the reserve portion via a docking gear. As the reserve portion rotates with respect to the container portion, the waste toner supplied to a conveyance path is conveyed from the inlet to the recovery inlet to be supplied to the reserve space.

9 Claims, 11 Drawing Sheets

(56) References Cited

FOREIGN PATENT DOCUMENTS

| | | | | |
|---|---|---|---|---|
| JP | 11-249418 | | 9/1999 | |
| JP | 2002-132109 | | 5/2002 | |
| JP | 2002132109 | * | 5/2002 | ..... G03G 15/08 |
| JP | 2003-255796 | * | 9/2003 | ..... G03G 21/10 |
| JP | 2003255796 | * | 9/2003 | ..... G03G 21/00 |
| JP | 2004-21132 | | 1/2004 | |
| JP | 2006-133397 | | 5/2006 | |
| JP | 3944710 | | 4/2007 | |
| JP | 2009210650 | * | 9/2009 | ..... G03G 21/10 |
| JP | 2011154268 | * | 8/2011 | ..... G03G 15/08 |

OTHER PUBLICATIONS

Chinese Office Action, Patent Application No. 201210544478.1. Mailing Date: Jul. 3, 2014, and English translation thereof (total of 13 pages).

* cited by examiner

RECOVERY UNIT AND IMAGE FORMING APPARATUS

CROSS-REFERENCE TO RELATED APPLICATIONS

The present application claims priority under 35 U.S.C. §119 to Japanese Patent Application No. 2011-274099, filed Dec. 15, 2011. The contents of this application are incorporated herein by reference in their entirety.

BACKGROUND OF THE INVENTION

1. Field of the Invention

The present invention relates to a recovery unit and an image forming apparatus including the recovery unit.

2. Discussion of the Background

Conventionally, a waste toner recovery box in which waste toner is dropped from an opening in an upper portion and the waste toner is recovered therein has been known (see, Japanese Unexamined Patent Application Publication No. 2004-021132, Japanese Unexamined Patent Application Publication No. 2006-133397, and Japanese Unexamined Patent Application Publication No. H11-249418, for example). Japanese Unexamined Patent Application Publication No. H11-249418 discloses a configuration in which the waste toner recovery box is disposed in an upper portion of an image forming apparatus, and developer to be discarded is upwardly conveyed through a connecting pipe incorporating a screw.

As described above, in the techniques disclosed in Japanese Unexamined Patent Application Publication No. 2004-021132, Japanese Unexamined Patent Application Publication No. 2006-133397, and Japanese Unexamined Patent Application Publication No. H11-249418, the waste toner is supplied from the upper portion of the recovery unit. Thus, a unit for conveying the waste toner to the upper portion of the recovery unit needs to be additionally provided.

In view of this, an object of the present invention is to provide a recovery unit that can favorably recover a waste developer with a simple configuration, and an image forming apparatus including the recovery unit.

SUMMARY OF THE INVENTION

To solve the problem, a first aspect of the present invention is a recovery unit configured to recover a waste developer conveyed from an image forming apparatus. The recovery unit includes a reserve portion, a container portion, and a driving transmitter. The reserve portion has a tubular shape and a spiral protrusion row on an outer peripheral surface, and is configured to reserve the waste developer in a reserve space inside the reserve portion. The container portion has a tubular shape and a first opening on a side wall, and is configured to incorporate the reserve portion. The driving transmitter is coupled to the reserve portion, and is configured to transmit driving force to rotate the reserve portion about a rotational shaft. An external diameter of the reserve portion including the protrusion row is same as an internal diameter of the container portion. As the reserve portion rotates about the rotational shaft, the waste developer conveyed through the first opening is conveyed upward by the protrusion row in a conveyance path defined by the protrusion row, the outer peripheral surface of the reserve portion, and an inner peripheral surface of the container portion, and is contained in the reserve space through a second opening formed in an upper portion of the reserve portion.

A second aspect of the present invention is that, in the recovery unit of the first aspect, the second opening may include a slit formed at an upper end of the reserve portion.

A third aspect of the present invention is that, in the recovery unit of the first aspect or the second aspect, the reserve portion may further include an end portion including an end surface, disposed near the second opening and facing the conveyance path.

A fourth aspect of the present invention is that, in the recovery unit of any one of the first aspect to the third aspects, while the waste developer is charged with a first polarity, at least a part of the conveyance path may be made of a material charged with a second polarity opposite to the first polarity of the waste developer.

A fifth aspect of the present invention is an image forming apparatus including: the recovery unit according to any one of the first to fourth aspects; a driving unit configured to transmit driving force to the driving transmitter; and a printer unit configured to form an image with toner on a recording medium. The recovery unit is replaceable and configured to recover the toner as the waste developer.

A sixth aspect of the present invention is that, the image forming apparatus of the fifth aspect may further include an introduction portion configured to push the toner toward the first opening to introduce the toner in the conveyance path.

BRIEF DESCRIPTION IF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
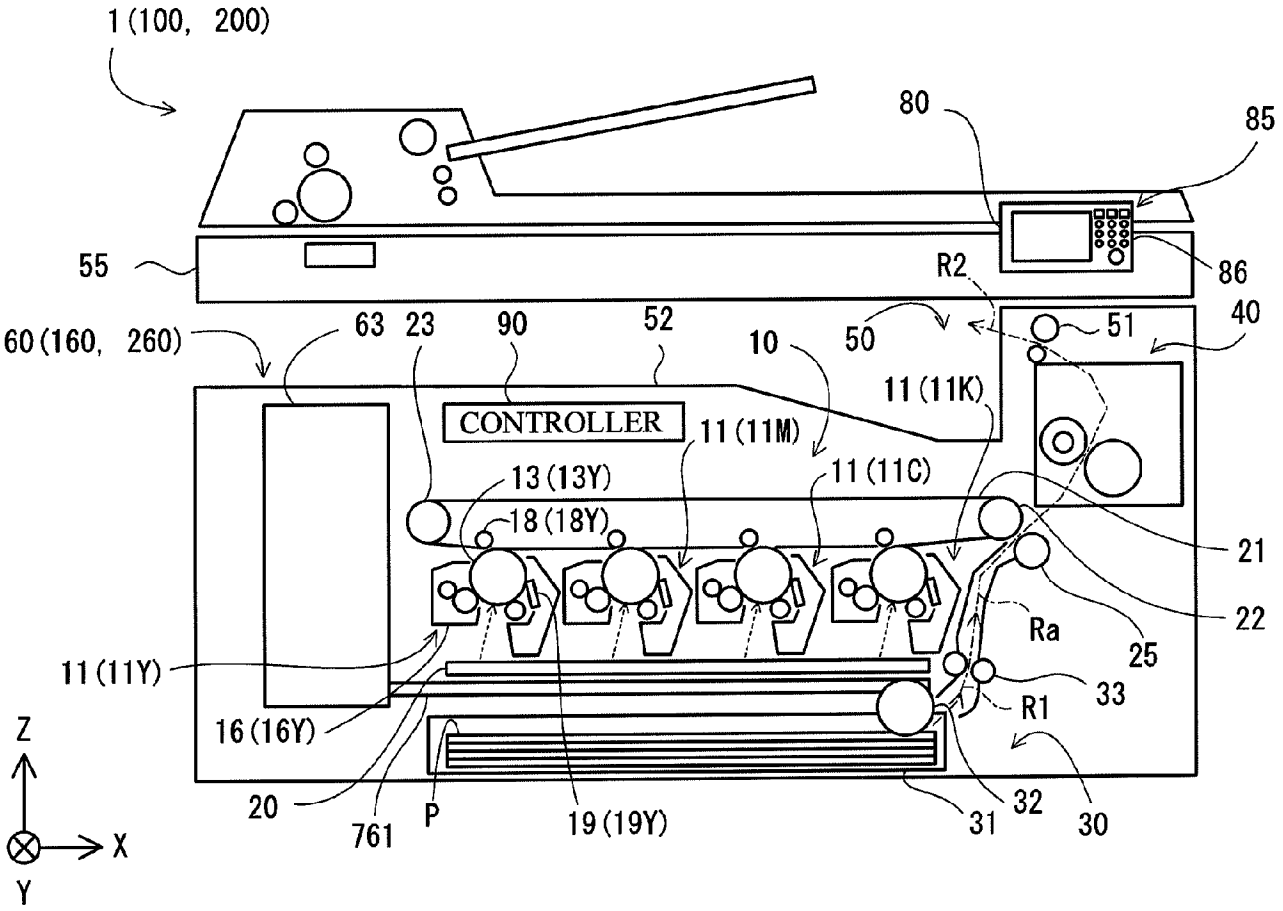
FIG. 1 is a front view showing an example of an overall configuration of an image forming apparatus of first and second embodiments of the present invention.

The embodiments will now be described with reference to the accompanying drawings, wherein like reference numerals designate corresponding or identical elements throughout the various drawings.

1. First Embodiment 1.1 Configuration of Image Forming Apparatus

FIG. 1 is a front view showing an example of an overall configuration of an image forming apparatus 1 of a first embodiment of the present invention. The image forming apparatus 1 prints a monochrome image or a color image by electrophotography. The image forming apparatus 1 can be incorporated in a multi-function machine integrally incorporating copy, printing, fax capabilities, and the like. As shown in FIG. 1, the image forming apparatus 1 mainly includes a printer unit 10, a sheet feeder 30, a fixing unit 40, a discharge unit 50, a scanner 55, a recovery unit 60, a display unit 80, and a controller 90.

FIG. 1 and drawings thereafter are provided with an XYZ orthogonal coordinate system in which a Z axis direction is a vertical direction and an XY plane is a horizontal surface, to clarify the directional relationship in the drawings.

The printer unit 10 forms a monochrome or color toner image on a recording medium P supplied through a sheet feed path R1 and a conveyance path Ra. As shown in FIG. 1, the printer unit 10 mainly includes image forming units 11 (11Y, 11M, 11C, and 11K), an exposure scanner 20, and an intermediate transfer belt 21.

The plurality of (4 in this embodiment) image forming units 11 respectively correspond to colors of yellow (Y), magenta (M), cyan (C), and black (K). As shown in FIG. 1, the image forming units 11 (11Y, 11M, 11C, and 11K) respectively mainly include photoreceptor drums 13 (13Y, 13M, 13C, and 13K), developing units 16 (16Y, 16M, 16C, and 16K), primary transfer rollers 18 (18Y, 18M, 18C, and 18K), and drum cleaners 19 (19Y, 19M, 19C, and 19K) and include the exposure scanner 20.

The printer unit 10 of this embodiment is so-called a tandem printer, and below and along the intermediate transfer belt 21, the image forming units 11 (11Y, 11M, 11C, and 11K) are arranged in the order of yellow (Y), magenta (M), cyan (C), and black (K) from the left side to the right side of FIG. 1.

In this embodiment, the image forming units 11Y, 11M, 11C, and 11K have the same hardware configuration. Thus, the image forming unit 11Y, and the photoreceptor drum 13Y, the developing unit 16Y, the primary transfer roller 18Y, and the drum cleaner 19Y as the components of the image forming unit 11Y are described in detail below.

For the convenience of illustration, the reference numerals of the photoreceptor drums 13M, 13C, and 13K, the developing units 16M, 16C, and 16K, the primary transfer rollers 18M, 18C, and 18K, and the drum cleaners 19M, 19C, and 19K are omitted in FIG. 1 and the drawings thereafter. In this embodiment, the image forming units 11Y to 11K and the developing units 16Y to 16K are respectively collectively referred to as the image forming unit 11 and the developing unit 16 in some cases.

The photoreceptor drum 13Y has a cylinder or column shape, and faces the primary transfer roller 18Y with the intermediate transfer belt 21 interposed therebetween. The photoreceptor drum 13Y includes a photoconductive film on an outer peripheral surface.

The outer peripheral surface of the photoreceptor drum 13Y is irradiated with light from the exposure scanner 20 so that charge in the irradiated area are removed. Thus, a yellow (Y) electrostatic latent image is formed on the outer peripheral surface of the photoreceptor drum 13Y. Similarly, magenta, cyan, and black electrostatic latent images are respectively formed on the outer peripheral surfaces of the photoreceptor drums 13M, 13C, and 13K.

The developing unit 16Y supplies yellow (Y) toner to the photoreceptor drum 13Y on which the electrostatic latent image is formed to form a toner image based on the electrostatic latent image on the outer peripheral surface of the photoreceptor drum 13Y.

As shown in FIG. 1, the primary transfer roller 18Y faces the photoreceptor drum 13Y with the intermediate transfer belt 21 interposed therebetween. The primary transfer roller 18Y is charged with a polarity that is opposite to that of the outer peripheral surface of the photoreceptor drum 13Y. Thus, when the intermediate transfer belt 21 is nipped by the rolling photoreceptor drum 13Y and the rolling primary transfer roller 18Y, the yellow (Y) toner image is transferred onto the intermediate transfer belt 21.

The drum cleaner 19Y removes remaining toner on the outer peripheral surface of the photoreceptor drum 13Y after the toner image is transferred on the intermediate transfer belt 21 and until the next yellow toner is supplied from the developing unit 16Y. As shown in FIG. 1, the drum cleaner 19Y is positioned to be capable of contacting the outer peripheral surface of the photoreceptor drum 13Y.

The exposure scanner 20 irradiates the photoreceptor drums 13 (13Y, 13M, 13C, and 13K) with a laser beam. Thus, the electrostatic latent images are formed on the outer peripheral surfaces of the photoreceptor drums 13 (13Y, 13M, 13C, and 13K).

The intermediate transfer belt 21 transfers the toner images of the four colors primary transferred by the image forming units 11 (11Y, 11M, 11C, and 11K), onto the recording medium P. As shown in FIG. 1, the intermediate transfer belt 21 is wound across a driving roller 22 and a driven roller 23 that rotate in the counterclockwise direction of FIG. 1. A secondary transfer roller 25 faces the driving roller 22 with the conveyance path Ra interposed therebetween and contacts the outer peripheral surface of the intermediate transfer belt 21.

Thus, by adjusting the feed timing of the intermediate transfer belt 21 and the conveyance timing of the recording medium P conveyed along the conveyance path Ra, the toner images of the four colors formed on the outer periphery of the intermediate transfer belt 21 are secondary transferred onto the recording medium P.

A developer supplied from the developing units 16 of the image forming units 11 is preferably a developer of one-component system using no carrier, but may be a developer of two-component system including toner and carrier. The material of the intermediate transfer belt 21 may be polycarbonate, polyimide, polyamidimide, and the like.

The primary and secondary transfer rollers 18 and 25 are so-called elastic rollers that are formed by adding ion conductive materials to synthetic rubber such as nitrile rubber and foaming the resultant object.

The sheet feeder 30 feeds the recording medium P to the printer unit 10. As shown in FIG. 1, the sheet feeder 30 mainly includes a sheet feed cassette 31 and a sheet feed roller 32.

The sheet feed cassette 31 is a container that can accommodate a plurality of recording media P. The sheet feed roller 32 picks up the recording media P accommodated in the sheet feed cassette 31 from the uppermost sheet, and supplies the picked-up recording medium P to the sheet feed path R1.

A pair of resist rollers 33 control the timing at which to feed the recording medium P to the conveyance path Ra. If the "direction of conveying the recording medium P" is defined as the "conveyance direction", the pair of resist rollers 33 are disposed more on the downstream side than the sheet feed roller 32 in the conveyance direction as shown in FIG. 1.

The fixing unit 40 fixes the toner images transferred on the recording medium P. As shown in FIG. 1 the fixing unit 40 is disposed more on the downstream side than the secondary transfer roller 25 in the conveyance path Ra.

The discharge unit 50 is disposed more on the downstream side than the fixing unit 40 in the conveyance direction, and discharges the recording medium P on which the toner image is fixed to the outside of the apparatus. Specifically, the recording medium P supplied to the discharge unit 50 through the conveyance path Ra is guided to a discharge path R2. As shown in FIG. 1, the discharge unit 50 mainly includes a pair of discharge rollers 51 disposed on the discharge path R2 and a discharge tray 52.

The scanner 55 reads an image on a document and is of an automatic document feeder (ADF) type or a flat bed type. As shown in FIG. 1, the scanner 55 is disposed above the discharge unit 50.

The recovery unit 60 recovers toner recovered from the image forming units 11, the intermediate transfer belt 21, and the like (hereinafter, also simply referred to as "waste toner"). The recovery unit 60 filled with the waste toner can be removed from the image forming apparatus and replaced. The configuration of the recovery unit 60 will be described later in detail.

The display unit 80 is formed of a liquid crystal display for example, and has a "touch panel" function of allowing a position in a screen to be pointed by touching the screen with a finger or a dedicated pen. Accordingly, the user of the image forming apparatus 1 (hereinafter, simply referred as "user") gives instruction by using the "touch panel" function of the display unit 80 based on the content displayed on the display unit 80 and thus can make the image forming apparatus 1 execute certain processing (such as processing of printing the toner image on the recording medium P supplied from the sheet feeder 30). As described above, the display unit 80 can be used as a reception unit that receives an input operation from the user.

An operation unit 85 is an input unit including a plurality of key pads. For example, when a print start button 86 in the operation unit 85 is pressed, the printing processing on the recording medium P is executed. Thus, like the display unit 80, the operation unit 85 can be used as the reception unit that receives the input operation from the user.

As shown in FIG. 1, the controller 90 is disposed below the discharge tray 52. The controller 90 controls various components of the image forming apparatus 1 and executes data calculation. For example, the controller 90 receives an image signal from an unillustrated external terminal and the like, converts the image signal into digitalized image data for Y-K color, and controls the operations of the printer unit 10, the sheet feeder 30, and the like. Thus, the printing processing on the recording medium P is executed.

1.2 Configuration of Recovery Unit

Figure 2:
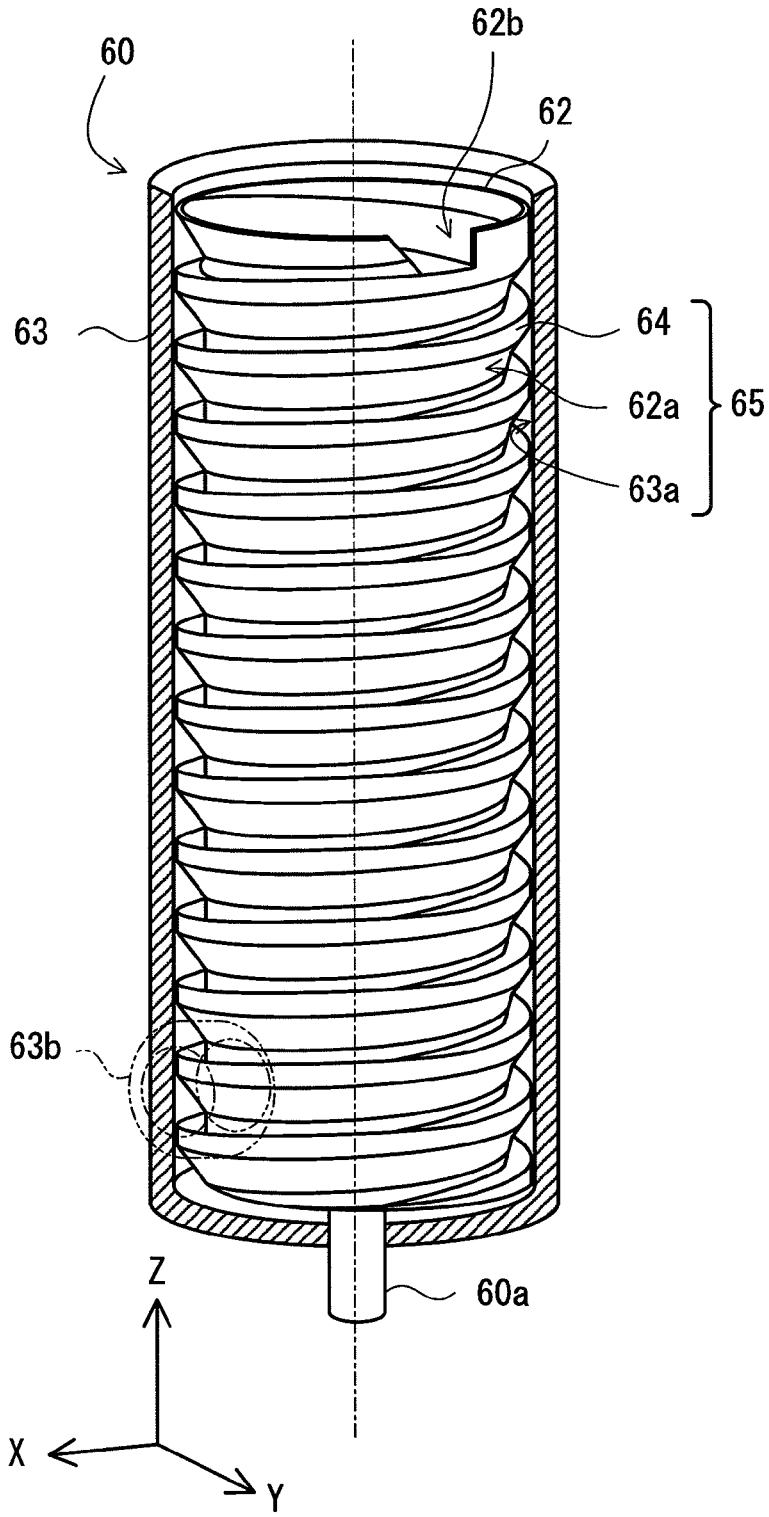
FIG. 2 is a side perspective view showing an example of a configuration of a recovery unit of the first embodiment.
Figure 3:
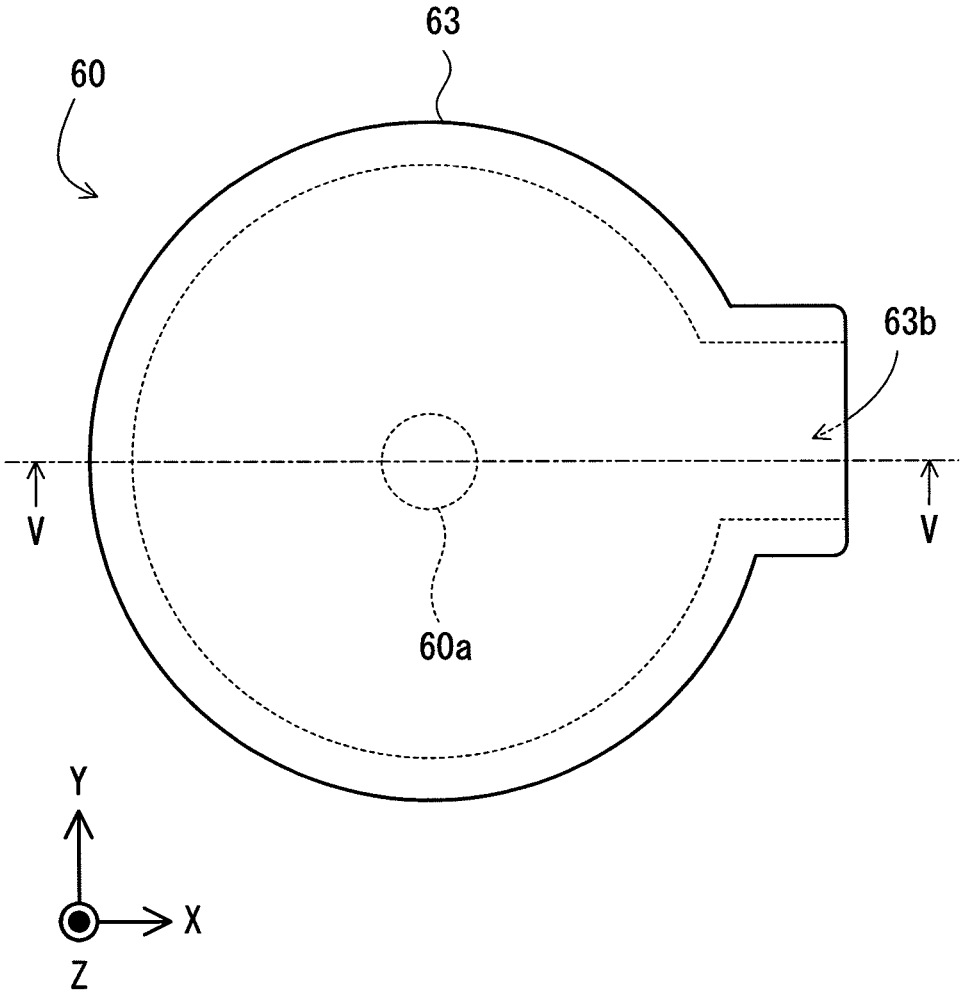
FIG. 3 is a plan view showing the example of the configuration of the recovery unit of the first embodiment.
Figure 4:
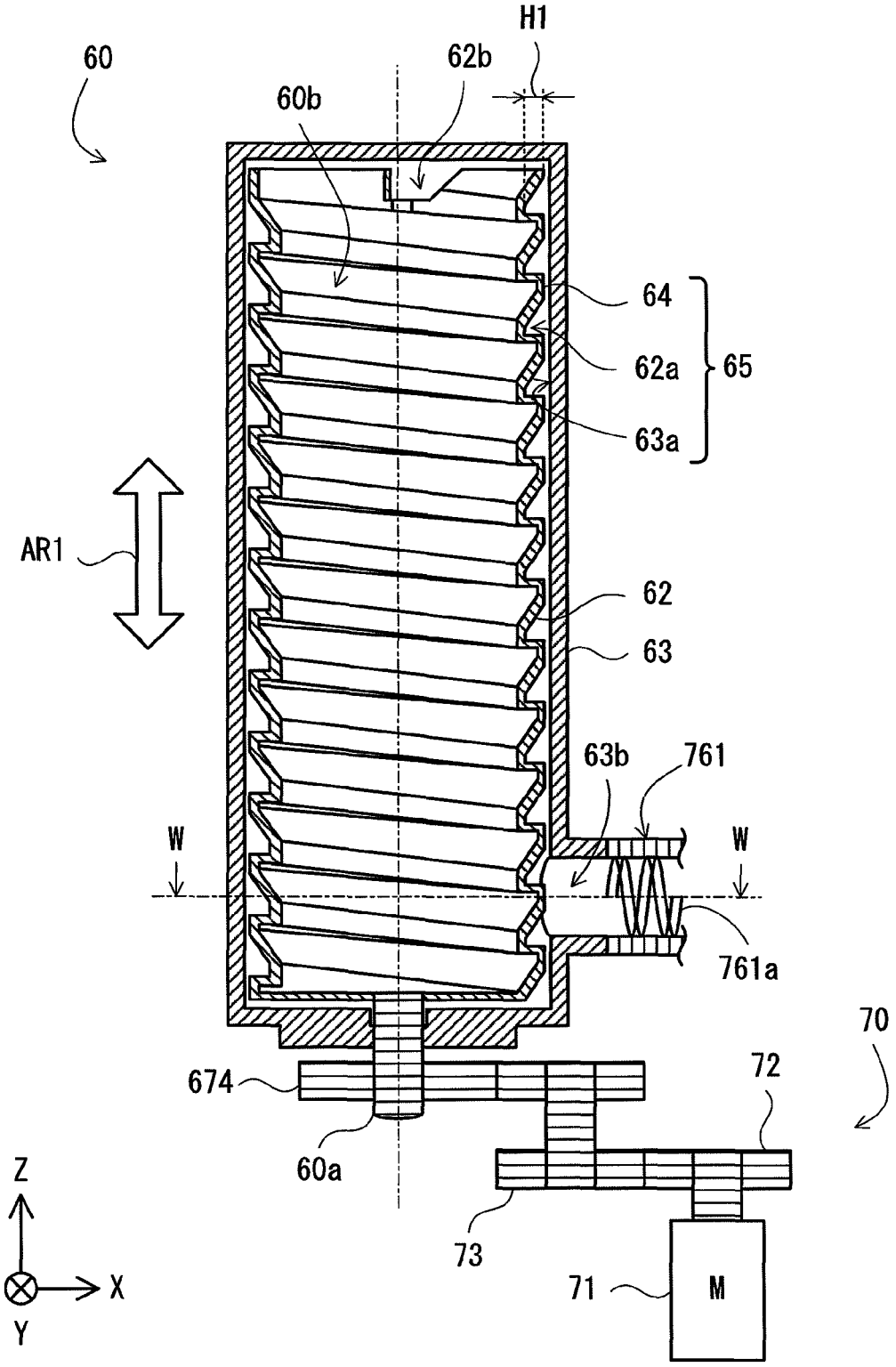
FIG. 4 is a cross-sectional view of the recovery unit taken along a line V-V in FIG. 3.
Figure 5:
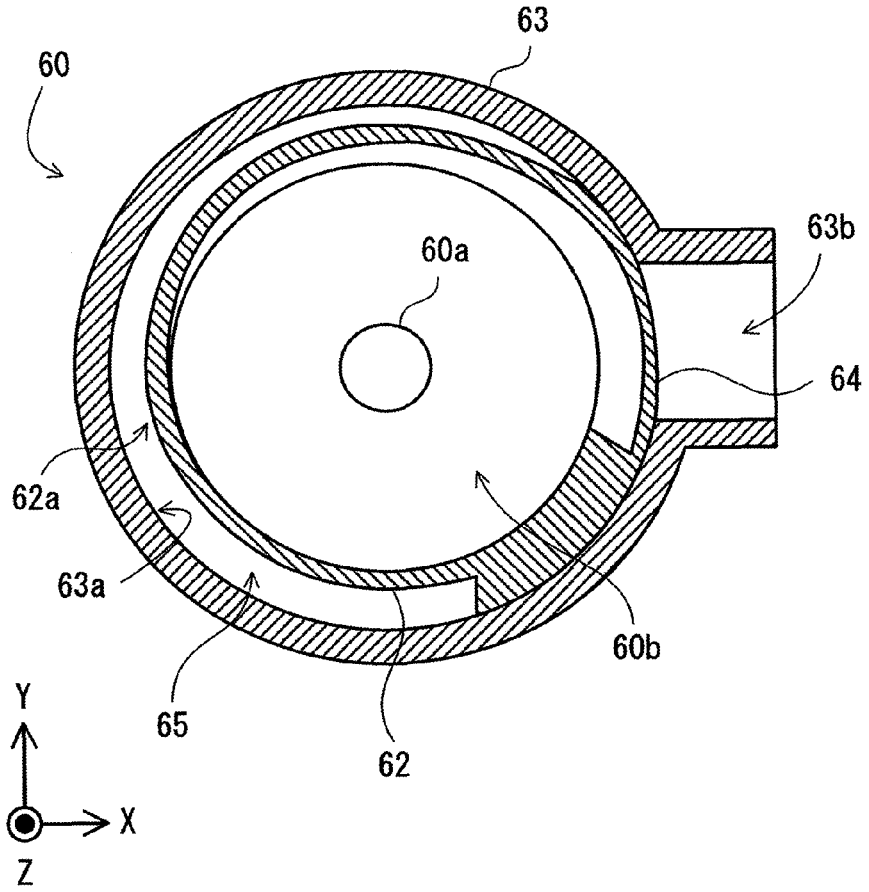
FIG. 5 is a cross-sectional view of the recovery unit taken along a line W-W in FIG. 4.
Figure 6:
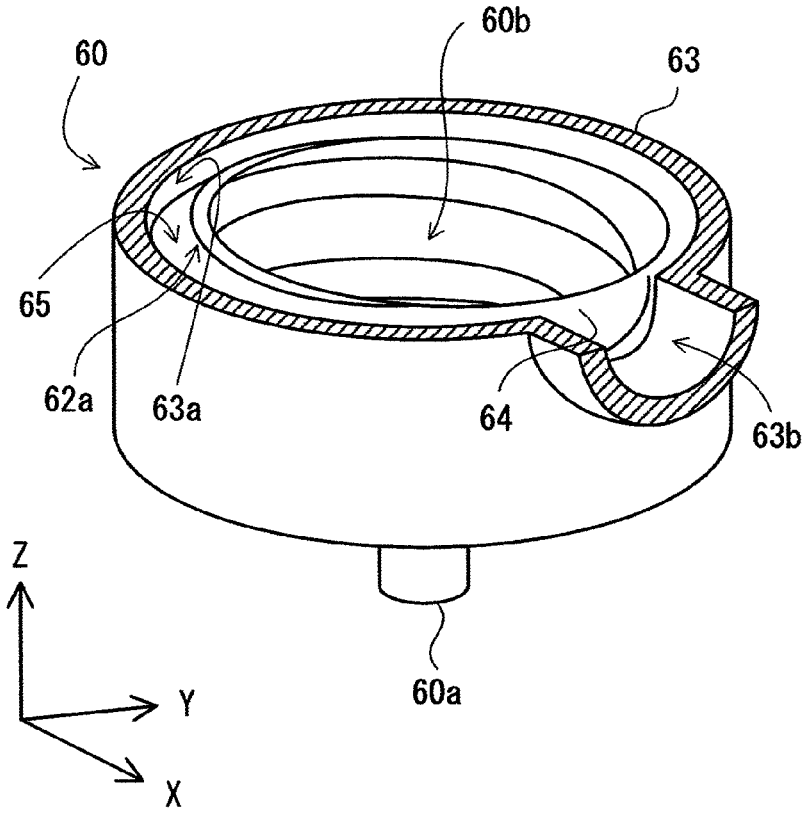
FIG. 6 is a perspective, cross-sectional view of the recovery unit around the line W-W in FIG. 4.
Figure 7:
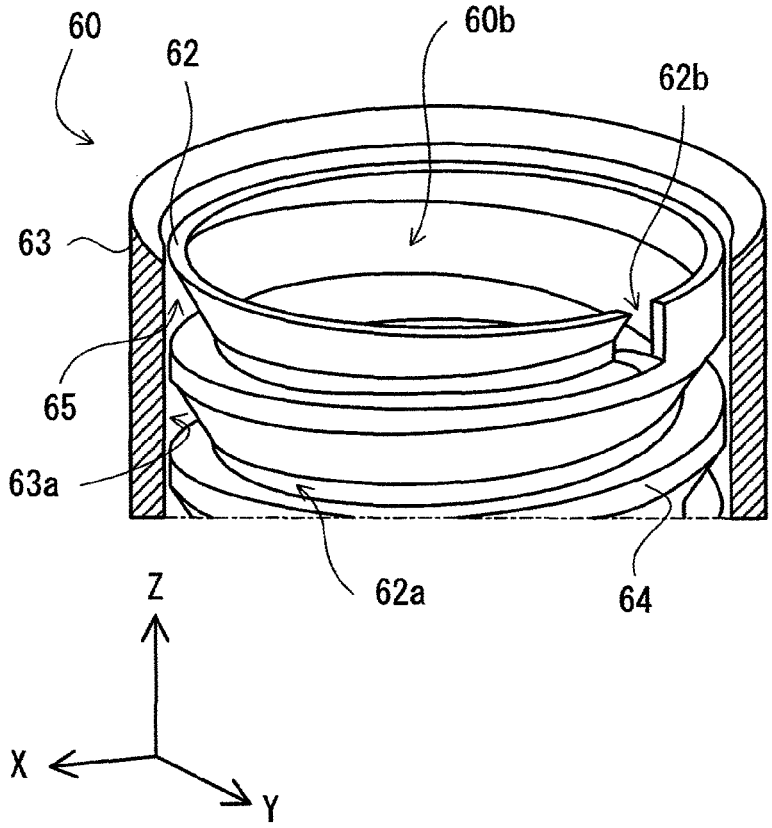
FIG. 7 is a perspective view showing an example of a configuration around an upper portion of a reserve portion of the first embodiment.

FIG. 2 and FIG. 3 are respectively a side perspective view and a plan view showing an example of a configuration of the recovery unit 60 of this embodiment. FIG. 4 is a cross-sectional view of the recovery unit 60 taken along a line V-V in FIG. 3. FIG. 5 is a cross-sectional view of the recovery unit 60 taken along a line W-W in FIG. 4. FIG. 6 is a perspective, cross-sectional view of the recovery unit 60 near the line W-W in FIG. 4. FIG. 7 is a perspective view showing an example of a configuration around an upper portion of the reserve portion 62 of this embodiment.

As described above, a recovery target of the recovery unit 60 is a solid body (for example, waste toner). As shown in FIG. 2 and FIG. 4, the recovery unit 60 mainly includes an introduction portion 761, the reserve portion 62, a container portion 63, a protrusion row 64, and a docking gear 674 as a driving transmission unit.

A driving unit 70 makes the reserve portion 62 rotate with respect to the container portion 63 about a rotational shaft 60*a* integrally formed with the reserve portion 62 via the docking gear 674. As shown in FIG. 4, the driving unit 70 mainly includes a motor 71, a driving gear 72, and a relay gear 73.

As shown in FIG. 4, the driving gear 72 is attached to a shaft center of the motor 71. Input and output sides of the relay gear 73 respectively mesh with the driving gear 72 and the docking gear 674. The docking gear 674 is attached to the rotational shaft 60*a*. The rotational shaft 60*a* is rotatably attached to the container portion 63 via an unillustrated bearing. Thus, the reserve portion 62 is rotated about the rotational shaft 60*a* by rotational force transmitted from the motor 71.

The introduction portion 761 receives the waste toner (waste developer) recovered from the image forming units 11, the intermediate transfer belt 21, and the like, and introduces the received waste toner to the recovery unit 60. As shown in FIG. 1, the introduction portion 761 is disposed below the image forming units 11 and the intermediate transfer belt 21.

As shown in FIG. 4, the introduction portion 761 includes a screw 761*a*. The screw 761*a* is rotatable in the introduction portion 761, and pushes the received waste toner toward an inlet 63*b* (first opening) of the container portion 63. Thus, the waste toner is introduced into a conveyance path 65 of the recovery unit 60 as the screw 761*a* rotates. Then, the waste toner introduced into the conveyance path 65 is packed by the pressure from the introduction portion 761.

The reserve portion 62 has a tubular shape with a main body having a circular cross section, and is an inner tube that reserves the waste toner in a reserve space 60*b* inside the main body of the reserve portion 62. The reserve portion 62 has a recovery inlet 62*b* (second opening) in the upper portion. More specifically, as shown in FIG. 2, FIG. 4, and FIG. 7, the recovery inlet 62*b* is a slit formed on an upper end of the reserve portion 62.

The container portion 63 has a tubular shape with a circular cross section, and is an outer tube incorporating the reserve portion 62. As shown in FIG. 2 and FIG. 4, the container portion 63 and the reserve portion 62 are concentrically disposed about the rotational shaft 60*a*. In a lower portion of a side wall of the container portion 63, the inlet 63*b* (first opening) penetrating the container portion 63 is formed. Thus, the inner space of the introduction portion 761 is communicatively coupled to the conveyance path 65 through the inlet 63*b*. A shutter may be provided between the introduction portion 761 and the inlet 63*b*. Thus, the waste toner can be prevented from leaking from the introduction portion 761 by the shutter while the recovery unit is removed. The inlet 63*b* may be provided at any position on the side wall of the container portion 63 as long as it is below the recovery inlet 62*b*.

As shown in FIG. 2 and FIG. 4 the protrusion row 64 protrudes from an outer peripheral surface 62*a* of the main body of the reserve portion 62, and extends in spiral along an extending direction (direction indicated by arrow AR1) of the rotational shaft 60*a*. The pitch of the spiral, that is, an inclination of the conveyance surface (of the protrusion row 64) with respect to the vertical direction is preferably set in consideration of the flowability of the waste toner. When the inclination is gentle, moving speed per rotation is low, but can prevent the toner from sliding toward the lower portion. As shown in FIG. 4, a height H1 of the protrusion row 64 is the same as a distance between an outer peripheral surface 62*a* of the reserve portion 62 and an inner peripheral surface 63*a* of the container portion 63. Thus, an external diameter of the reserve portion 62 including the protrusion row 64 is approximately the same as an internal diameter of the container portion 63. Thus, the reserve portion 62 is loaded in the container portion 63 almost with no space therebetween.

The conveyance path 65 is a path of the waste toner in the recovery unit 60 and connects between the inlet 63*b* and the recovery inlet 62*b*. As shown in FIG. 2 and FIG. 4 to FIG. 7, the conveyance path 65 is formed as a space defined by the outer peripheral surface 62*a* of the reserve portion 62, the inner peripheral surface 63*a* of the container portion 63, and the protrusion row 64 of the reserve portion 62.

Thus, the waste toner is conveyed from the inlet 63*b* to the recovery inlet 62*b* along the conveyance path 65 as the reserve portion 62 rotates with respect to the container portion 63 (counterclockwise in a top view of FIG. 5). Then, the waste toner is supplied to the reserve space 60*b* through the recovery inlet 62*b*.

1.3 Advantage of Recovery Unit of First Embodiment

As described above, the recovery unit 60 of the first embodiment can supply the waste toner to the reserve space 60*b* of the reserve portion 62 through the inlet 63*b* formed in the lower portion of the container portion 63, the conveyance path 65, and the recovery inlet 62*b* formed in the upper portion of the reserve portion 62.

The waste toner is thus conveyed from the lower portion to the upper portion in the recovery unit 60. Thus, no unit for conveying the waste toner to the upper portion of the recovery unit 60 is needed. Accordingly, the unit required for recovering the waste toner can be downsized as a whole.

The waste toner is pushed into the conveyance path 65 by the pushing operation of the introduction portion 761. Thus, the waste toner introduced into the conveyance path 65 is packed by the pressure from the introduction portion 761, and conveyed in the packed state. Thus, the waste toner can be conveyed from the inlet 63*b* to the recovery inlet 62*b* more efficiently.

1.4 Modification

In FIG. 4, an example is shown where the toner is pushed by the introduction portion 761 to be conveyed upward efficiently. In addition to this, or instead of this, the following configuration (or an example in FIG. 11 described later) may be employed.

When the toner used in this embodiment is conveyed along the conveyance path 65, for example, the waste developer at the point of reaching the recovery unit is negatively charged (first polarity) in the upstream image forming processing. Thus, the conveyance path 65 may be made of a material having property positively charged (second polarity) for the polarity opposite to that of the waste developer. Thus, the protrusion row 64 or the inner peripheral surface of the container portion 63 can be positively charged by the sliding friction at the time of rotation of the protrusion row 64 and the container portion 63. Accordingly, the waste toner being conveyed is attracted to the conveyance path 65 by the electrostatic force. Thus, the waste toner can be more efficiently conveyed from the inlet 63*b* to the recovery inlet 62*b*.

In this embodiment, portions of the reserve portion 62, the container portion 63, and the protrusion row 64 defining the conveyance path 65 may have a surface condition with higher friction resistance compared with other portions (for example, rough surface processing may be performed on the outer peripheral surface 62*a*, the inner peripheral surface 63*a*, and the protrusion row 64), or may be made of a material having higher friction resistance. If the friction resistance between the waste toner and the wall surfaces of the conveyance path is high, while the toner is conveyed upward against gravity, the waste toner can be prevented from sliding toward the lower portion in a case where the waste toner has high flowability. Also in this case, the waste toner can be more efficiently conveyed from the inlet 63*b* to the recovery inlet 62*b*.

2. Second Embodiment

Next, a second embodiment of the present invention is described. An image forming apparatus 100 of the second embodiment is the same as that of the first embodiment except that the reserve portion 62 of the image forming apparatus 1 of the first embodiment is replaced with a reserve portion 162. Thus, the difference is mainly described below.

The common components in the image forming apparatuses 1 and 100 are denoted with the same reference numerals and are already described in the first embodiment. Thus, the description thereof is omitted in this embodiment.

2.1 Configuration of Recovery Unit

Figure 8:
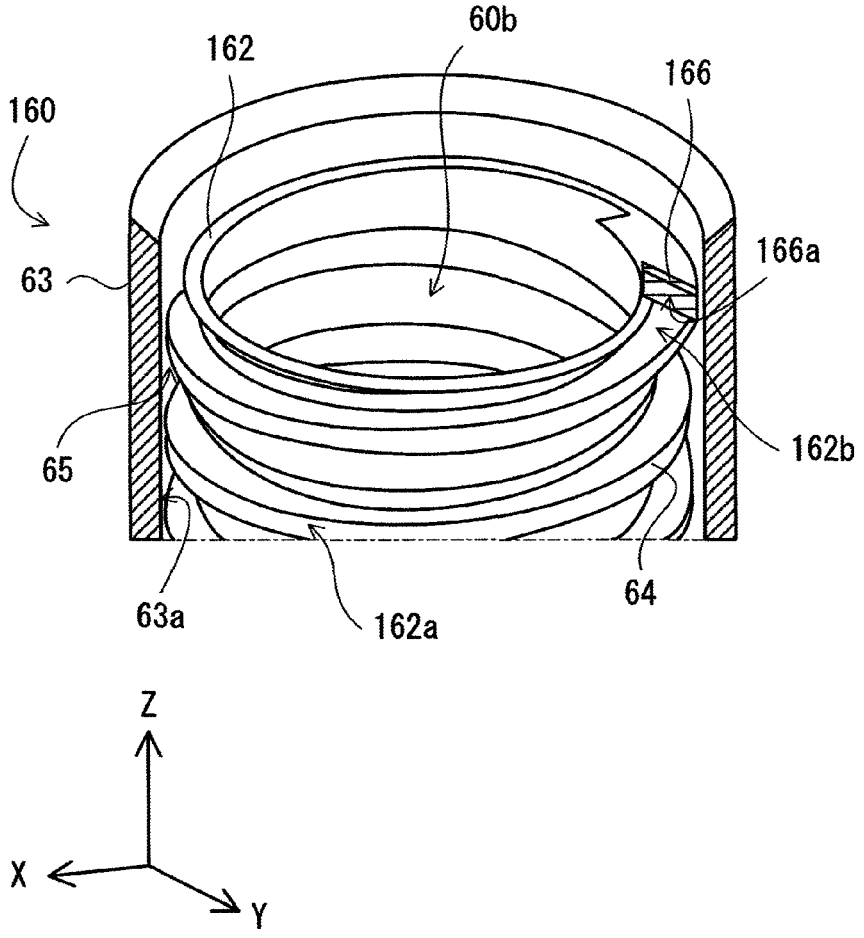
FIG. 8 is a perspective view showing an example of a configuration around an upper portion of a reserve portion of a second embodiment.
Figure 9:
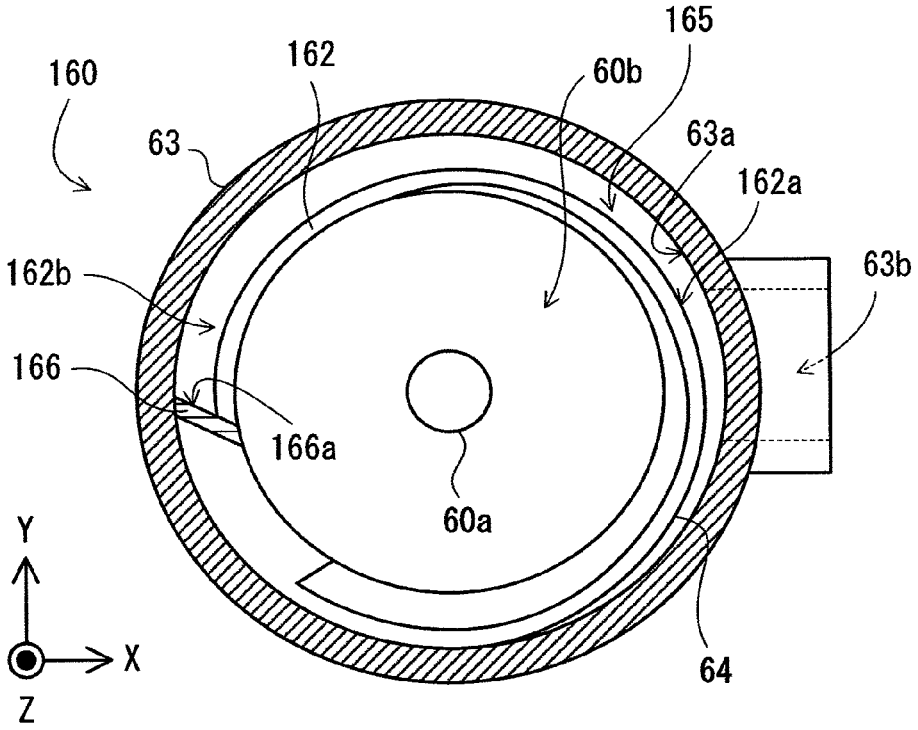
FIG. 9 is a cross-sectional view showing the example of the configuration around the upper portion of the reserve portion of the second embodiment.

FIG. 8 and FIG. 9 are respectively a perspective view and a cross-sectional view showing an example of a configuration around an upper portion of the reserve portion 162 of this embodiment. As shown in FIG. 8 and FIG. 9, a recovery unit 160 mainly includes the reserve portion 162, the container portion 63, the protrusion row 64, and an end portion 166.

Like the conveyance path 65 of the first embodiment, a conveyance path 165 is a path for the waste toner in the recovery unit 160, and connects between the inlet 63*b* and a recovery inlet 162*b* as shown in FIG. 9. As shown in FIG. 8, the conveyance path 165 is formed as a space defined by an outer peripheral surface 162*a* of the reserve portion 162 and the inner peripheral surface 63*a* of the container portion 63, and the protrusion row 64.

Like the reserve portion 62 of the first embodiment, the reserve portion 162 has a tubular shape, and is an inner tube that reserves the waste toner in the reserve space 60*b* therein. The reserve portion 162 has the recovery inlet 162*b* in an upper portion. As in the first embodiment, the recovery inlet 162*b* and the inlet 63*b* are respectively formed at upper and lower ends of the conveyance path 165.

Thus, the waste toner is conveyed from the inlet 63*b* to the recovery inlet 162*b* along the conveyance path 165 as the reserve portion 162 rotates with respect to the container portion 63. Then, the waste toner is supplied to the reserve space 60*b* through the recovery inlet 162*b*.

The end portion 166 is a plate disposed near the recovery inlet 162*b* at the upper portion of the reserve portion 162 and includes an end surface 166*a* facing the conveyance path 165. More specifically, as shown in FIG. 8 and FIG. 9, the end portion 166 is disposed in such a manner that the end surface 166*a* becomes orthogonal to the conveyance path 165. Thus, the waste toner conveyed along the conveyance path 165 hits on the end surface 166*a* of the end portion 166 to be introduced into the recovery inlet 162*b*.

2.2 Advantage of Recovery Unit of Second Embodiment

Like the recovery unit 60 of the first embodiment, the recovery unit 160 of the second embodiment requires no unit for conveying the waste toner to the upper portion of the recovery unit 160. Accordingly, the unit required for recovering the waste toner can be downsized as a whole.

In the recovery unit 160 of the second embodiment, the waste toner conveyed along the conveyance path 165 hits on the end portion 166 near the recovery inlet 162*b*. Thus, the waste toner conveyed hit on the end portion 166 is introduced into the reserve space 60*b* through the recovery inlet 162*b*. Therefore, the waste toner conveyed to the upper portion of the conveyance path 165 can be surely supplied to the reserve space 60*b*.

3. Third Embodiment

Next, a third embodiment of the present invention is described. An image forming apparatus 200 of the third embodiment is the same as that of the first embodiment except that the recovery unit 60 of the image forming apparatus 1 of the first embodiment is replaced with a recovery unit 260. Thus, the difference is mainly described below.

The common components in the image forming apparatuses 1 and 200 are denoted with the same reference numerals and are already described in the first embodiment. Thus, the description thereof is omitted in this embodiment.

3.1 Configuration of Recovery Unit

Figure 10:
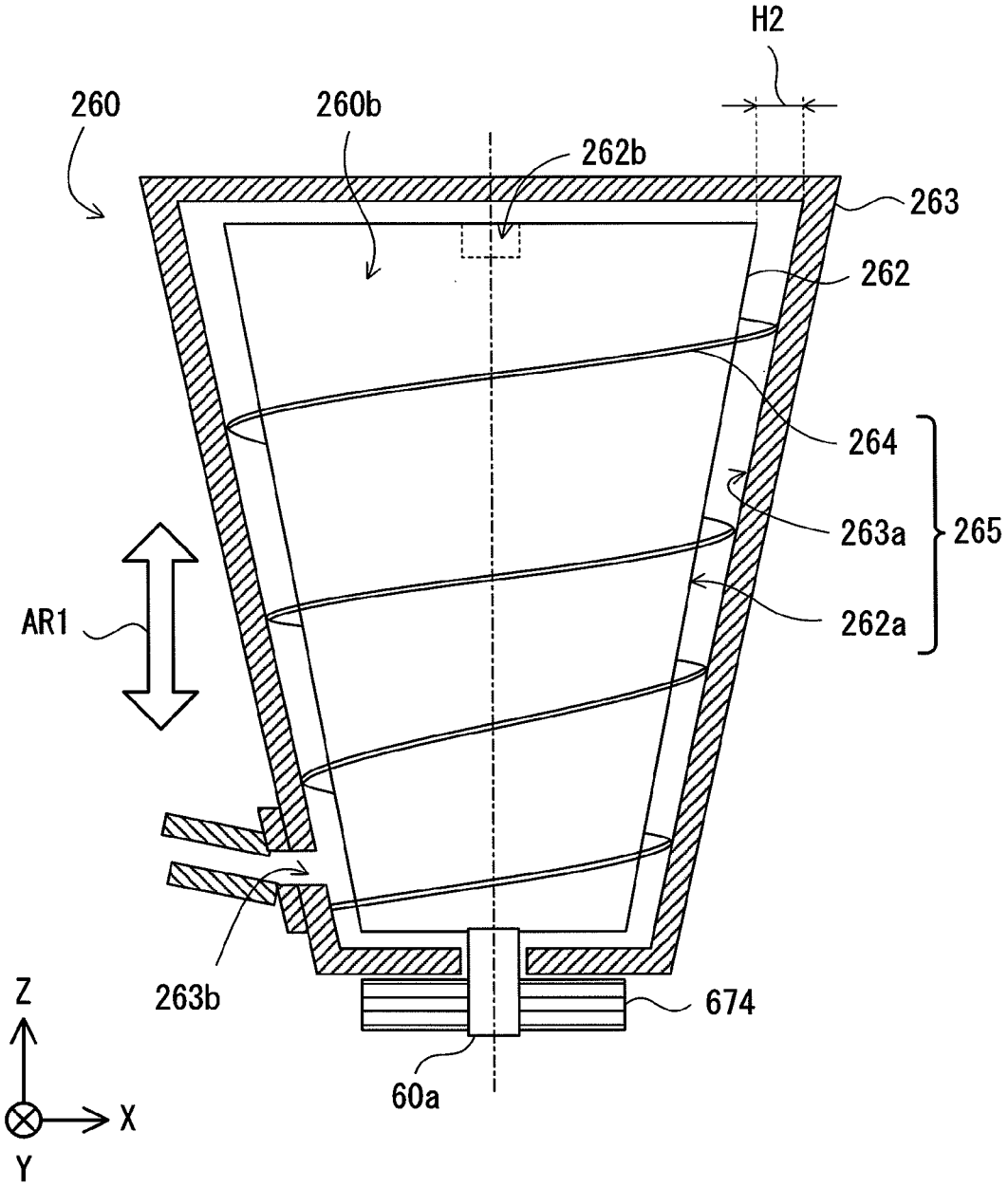
FIG. 10 is a schematic front view showing an example of a configuration of a recovery unit of a third embodiment.

FIG. 10 is a schematic front view showing an example of a configuration of the recovery unit 260 of this embodiment. Like the recovery unit 60 of the first embodiment, the recovery unit 260 is a unit for recovering the waste toner. As shown in FIG. 10, the recovery unit 260 mainly includes a reserve portion 262, a container portion 263, and a protrusion row 264.

The reserve portion 262 has a tubular shape, and is an inner tube that reserves the waste toner in a reserve space 260*b* therein. As shown in FIG. 10, the internal diameter of the reserve portion 262 gradually increases as it gets farther from the rotational shaft 60*a* along the extending direction (direction indicated by the arrow AR1) of the rotational shaft 60*a*. Like the reserve portion 62 of the first embodiment, the reserve portion 262 has a recovery inlet 262*b* (second opening) in the upper portion.

The container portion 263 has a tubular shape, and incorporates the reserve portion 262. As shown in FIG. 10, the internal diameter of the container portion 263 gradually increases as it gets farther from the rotational shaft 60*a* along the extending direction of the rotational shaft 60*a*. The container portion 263 and the reserve portion 262 are concentrically disposed about the rotational shaft 60*a*. The container portion 263 has an inlet 263*b* penetrating the container portion 263 in the lower portion.

Like the protrusion row 64 of the first embodiment, the protrusion row 264 protrudes from an outer peripheral surface 262*a* of the reserve portion 262, and extends in spiral along the extending direction of the rotational shaft 60*a*. As shown in FIG. 10, a height H2 of the protrusion row 264 is the same as a distance between the outer peripheral surface 262*a* of the reserve portion 262 and an inner peripheral surface 263*a* of the container portion 263. Thus, an external diameter of the reserve portion 262 including the protrusion row 264 is approximately the same as an internal diameter of the container portion 263, when compared in the cross-sectional views taken along a direction orthogonal to the rotational shaft. Thus, the reserve portion 262 is loaded in the container portion 263 almost with no space therebetween.

Like the conveyance path 65 of the first embodiment, the conveyance path 265 is a path for the waste toner in the recovery unit 260, and connects between the inlet 263*b* and a recovery inlet 262*b*. As shown in FIG. 10, the conveyance path 265 is formed as a space defined by the outer peripheral surface 262*a* of the reserve portion 262, the inner peripheral surface 263*a* of the container portion 263, and the protrusion row 264.

Thus, the waste toner is conveyed from the inlet 263*b* to the recovery inlet 262*b* along the conveyance path 265 as the reserve portion 262 rotates with respect to the container portion 263. Then, the waste toner is supplied to the reserve space 260*b* through the recovery inlet 262*b*.

3.2 Advantage of Recovery Unit of Third Embodiment

Like the recovery units 60 and 160 of the first and second embodiments, the recovery unit 260 of the third embodiment requires no unit for conveying the waste toner to the upper portion of the recovery unit 260. Accordingly, the unit required for recovering the waste toner can be downsized as a whole.

In the recovery unit 260 of the third embodiment, the internal diameter of the main body of the reserve portion 262 is the smallest at the lower portion and gradually increases as it gets closer to the upper portion along the extending direction (direction indicated by the arrow AR1) of the rotational shaft 60*a*. Thus, the internal diameter of the main body of the reserve portion 262 is larger at a portion near the recovery inlet 262*b* than the other portion. Thus, the waste toner is supplied from the upper portion of the reserve portion 262 where the diameter is large. Thus, the waste toner can be supplied into the reserve space 60*b* more easily.

4. Modification

The embodiments of the present invention are described above. The present invention is not limited to the embodiments and can be modified in various ways.

First Modification

In the first to the third embodiments, the reserve portions 62, 162, and 262 are each rotated with respect to the corresponding one of the container portion 63 and 263 by the driving unit 70. However, the present invention is not limited to this. For example, the driving unit 70 may add driving force for reciprocating movement along the rotational shaft 60*a* (for example, vertical vibration) to the reserve portions 62, 162, and 262, along with rotational force. Also in this case, the waste toner supplied from the lower portion of the recovery units 60, 160, and 260 can be favorably recovered.

Second Modification

In the first to the third embodiments, the recovery units 60, 160, and 260 are disposed in such a manner that the rotational shaft 60*a* becomes parallel with the vertical direction (Y axis direction). The arrangement of the recovery units 60, 160, and 260 is not limited to this.

Figure 11:
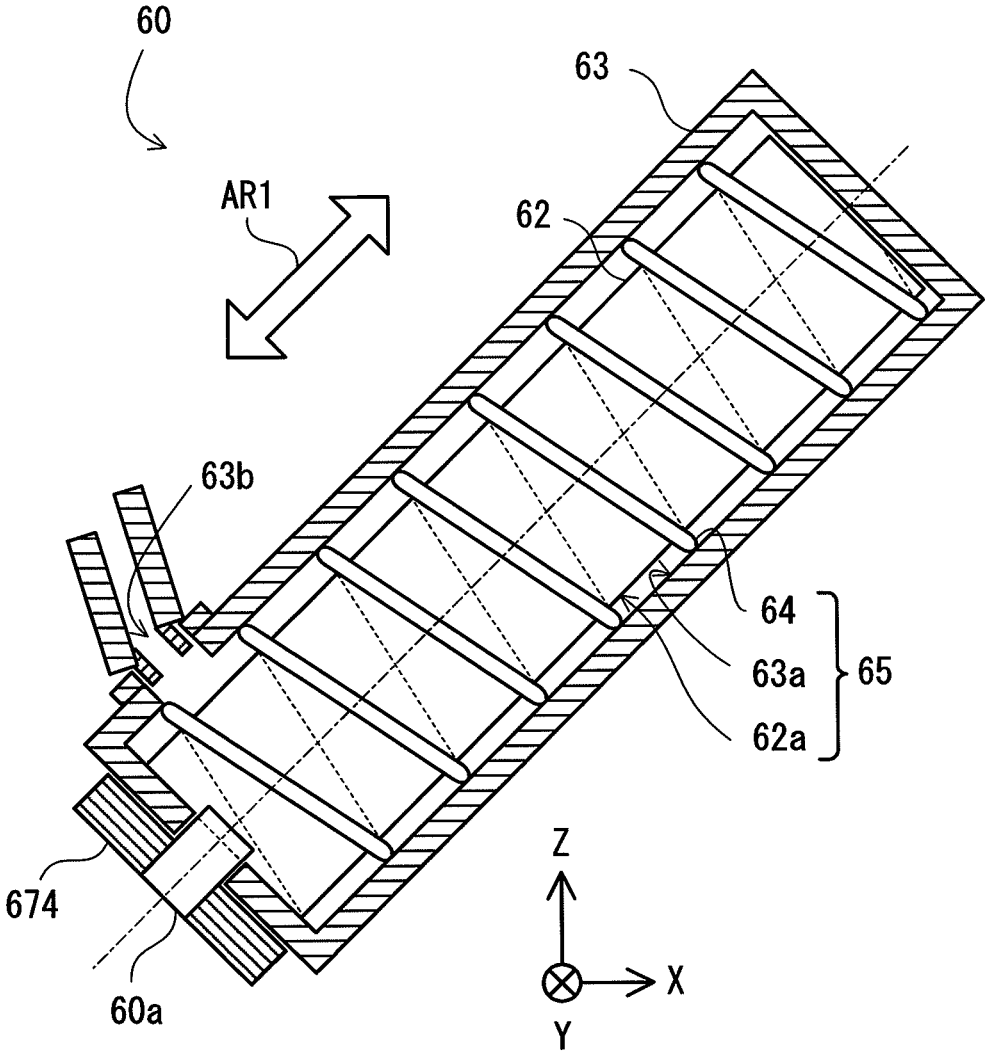
FIG. 11 is a schematic front view showing another example of an arrangement of the recovery unit of the embodiment.

FIG. 11 is a schematic front view showing another example of the arrangement of the recovery unit of the embodiment. For example, the recovery units 60, 160, and 260 (only the recovery unit 60 is shown in FIG. 11) may each be disposed in the corresponding one of the image forming apparatuses 1, 100, and 200 in such a manner that the rotational shaft 60*a* is inclined with respect to the Y axis in the vertical direction of the rotation shaft 60*a*. Also in this case, the waste toner supplied from the lower portion of the recovery units 60, 160, and 260 can be favorably recovered.

According to the first to sixth aspects of the present invention, a waste developer is supplied to a reserve space in a reserve portion through a first opening formed on a side wall of a container portion, a conveyance path, and a second opening formed in an upper portion of the reserve portion.

The waste developer is thus conveyed from a lower portion to an upper portion of a recovery unit. Thus, no unit for conveying the waste developer to the upper portion of the recovery unit is needed. Accordingly, the unit required for recovering the waste developer can be downsized as a whole.

Particularly, according to the third aspect of the present invention, a target conveyed along the conveyance path hits on an end portion near the second opening. Thus, the waste developer hit on the end portion is introduced in the reserve space through the second opening. Therefore, the waste developer conveyed to an upper portion of the conveyance path can be surely supplied to the reserve space.

Particularly, according to the fourth aspect of the present invention, at least a part of the conveyance path has a polarity opposite to a polarity of the waste developer. Thus, the waste developer is attracted to the conveyance path by the electrostatic force. Thus, the waste developer can be more efficiently conveyed from the first opening to the second opening.

Particularly, according to the sixth aspect of the present invention, the waste developer is pushed into the conveyance path by a pushing operation by an introduction portion. Thus, the waste developer introduced to the conveyance path is packed by pressure from the introduction portion. Thus, the waste developer can be more efficiently conveyed from the first opening to the second opening.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A recovery unit configured to recover a waste developer conveyed from an image forming apparatus, comprising:

a reserve portion having a tubular shape, comprising a spiral protrusion row on an outer peripheral surface, and configured to reserve the waste developer in a reserve space defined inside the spiral protrusion row of the reserve portion;

a container portion having a tubular shape and a first opening on a side wall, and configured to incorporate the reserve portion; and a driving transmitter coupled to the reserve portion, and configured to transmit driving force to rotate the reserve portion about a rotational shaft, wherein an external diameter of the reserve portion including the protrusion row is same as an internal diameter of the container portion, and wherein, as the reserve portion rotates about the rotational shaft, the waste developer conveyed through the first opening is conveyed upward by the protrusion row in a conveyance path defined by the protrusion row, the outer peripheral surface of the reserve portion, and an inner peripheral surface of the container portion, and is contained in the reserve space through a second opening formed in an upper portion of the reserve portion.

2. The recovery unit according to claim 1, wherein the second opening comprises a slit formed at an upper end of the reserve portion.

3. The recovery unit according to claim 1, wherein the reserve portion further comprises an end portion including an end surface, disposed near the second opening and facing the conveyance path.

4. The recovery unit according to claim 1, wherein while the waste developer is charged with a first polarity, at least a part of the conveyance path is made of a material charged with a second polarity opposite to the first polarity.

5. An image forming apparatus comprising:

the recovery unit according to claim 1;

a driving unit configured to transmit driving force to the driving transmitter; and a printer unit configured to form an image with toner on a recording medium, wherein the recovery unit is replaceable and configured to recover the toner as the waste developer.

6. The image forming apparatus according to claim 5 further comprising an introduction portion configured to push the toner toward the first opening to introduce the toner in the conveyance path.

7. A recovery unit configured to recover a waste developer conveyed from an image forming apparatus, comprising:

a reserve portion having a tubular shape, comprising a spiral protrusion row on an outer peripheral surface, and configured to reserve the waste developer in a reserve space inside the reserve portion;

a container portion having a tubular shape and a first opening on a side wall, and configured to incorporate the reserve portion; and a driving transmitter coupled to the reserve portion, and configured to transmit driving force to rotate the reserve portion about a rotational shaft, wherein an external diameter of the reserve portion including the protrusion row is same as an internal diameter of the container portion, wherein, as the reserve portion rotates about the rotational shaft, the waste developer conveyed through the first opening is conveyed upward by the protrusion row in a conveyance path defined by the protrusion row, the outer peripheral surface of the reserve portion, and an inner peripheral surface of the container portion, and is contained in the reserve space through a second opening formed in an upper portion of the reserve portion, and wherein the second opening comprises a slit formed at an upper end of the reserve portion.

8. A recovery unit configured to recover a waste developer conveyed from an image forming apparatus, comprising:

a reserve portion having a tubular shape, comprising a spiral protrusion row on an outer peripheral surface, and configured to reserve the waste developer in a reserve space inside the reserve portion;

a container portion having a tubular shape and a first opening on a side wall, and configured to incorporate the reserve portion; and a driving transmitter coupled to the reserve portion, and configured to transmit driving force to rotate the reserve portion about a rotational shaft, wherein an external diameter of the reserve portion including the protrusion row is same as an internal diameter of the container portion, wherein, as the reserve portion rotates about the rotational shaft, the waste developer conveyed through the first opening is conveyed upward by the protrusion row in a conveyance path defined by the protrusion row, the outer peripheral surface of the reserve portion, and an inner peripheral surface of the container portion, and is contained in the reserve space through a second opening formed in an upper portion of the reserve portion, and wherein the reserve portion further comprises an end portion including an end surface, disposed near the second opening and facing the conveyance path.

9. A recovery unit configured to recover a waste developer conveyed from an image forming apparatus, comprising:

a reserve portion having a tubular shape, comprising a spiral protrusion row on an outer peripheral surface, and configured to reserve the waste developer in a reserve space inside the reserve portion;

a container portion having a tubular shape and a first opening on a side wall, and configured to incorporate the reserve portion; and a driving transmitter coupled to the reserve portion, and configured to transmit driving force to rotate the reserve portion about a rotational shaft, wherein an external diameter of the reserve portion including the protrusion row is same as an internal diameter of the container portion, wherein, as the reserve portion rotates about the rotational shaft, the waste developer conveyed through the first opening is conveyed upward by the protrusion row in a conveyance path defined by the protrusion row, the outer peripheral surface of the reserve portion, and an inner peripheral surface of the container portion, and is contained in the reserve space through a second opening formed in an upper portion of the reserve portion, and wherein while the waste developer is charged with a first polarity, at least a part of the conveyance path is made of a material charged with a second polarity opposite to the first polarity.

* * * * *